US010522932B2

(12) United States Patent
Chiba et al.

(10) Patent No.: US 10,522,932 B2
(45) Date of Patent: Dec. 31, 2019

(54) TERMINAL HOLDING STRUCTURE OF CONNECTOR

(71) Applicant: Yazaki Corporation, Tokyo (JP)

(72) Inventors: Shingo Chiba, Shizuoka (JP); Akira Shinchi, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 313 days.

(21) Appl. No.: 15/238,801

(22) Filed: Aug. 17, 2016

(65) Prior Publication Data

US 2016/0359257 A1 Dec. 8, 2016

Related U.S. Application Data

(63) Continuation of application No. PCT/JP2015/056106, filed on Mar. 2, 2015.

(30) Foreign Application Priority Data

Mar. 19, 2014 (JP) ..... 2014-057295

(51) Int. Cl.
*H01R 13/41* (2006.01)
*H01R 12/72* (2011.01)

(52) U.S. Cl.
CPC ..... *H01R 13/41* (2013.01); *H01R 12/724* (2013.01)

(58) Field of Classification Search
CPC .... H01R 13/41; H01R 13/04; H01R 23/7073; H01R 12/585; H01R 43/16
(Continued)

(56) References Cited

U.S. PATENT DOCUMENTS 3,670,294 A 6/1972 Johnson et al.
4,469,394 A * 9/1984 Verhoeven ..... H01R 12/58 439/873
(Continued)

FOREIGN PATENT DOCUMENTS

CN 103329361 A 9/2013
JP 56-43586 U 4/1981
(Continued)

OTHER PUBLICATIONS

International Search Report of PCT/JP2015/056106 dated May 12, 2015.
(Continued)

*Primary Examiner* — Hien D Vu
(74) *Attorney, Agent, or Firm* — Sughrue Mion, PLLC

(57) ABSTRACT

In a terminal holding structure of a connector, a straight portion of a terminal is press fitted into a terminal holding hole formed on a terminal holding wall of a resin housing, so as to be held therein. At least a pair of projecting portions projecting to both sides in a direction orthogonal to a press-fitting direction is formed on the outer surface of a region of the straight portion of the terminal corresponding to the terminal holding hole. The projecting portions are formed with the cross-section orthogonal to the straight portion including a wedge-shaped dent at a distal end. The dents are formed such that a dimension between bottom portions is larger than the dimension of the terminal holding hole at the position into which the projecting portions are press fitted. This enhances the holding power to the terminal, and enables the terminal to be held stably.

6 Claims, 11 Drawing Sheets

(58) Field of Classification Search
USPC ..... 439/733.1, 869
See application file for complete search history.

(56) References Cited

U.S. PATENT DOCUMENTS

| | | | | |
|---|---|---|---|---|
| 5,263,880 | A * | 11/1993 | Schwarz | H01R 13/405 174/538 |
| 5,897,401 | A * | 4/1999 | Fili | H01R 13/41 411/451.1 |
| 6,042,429 | A * | 3/2000 | Bianca | H01R 13/41 439/733.1 |
| 6,328,576 | B1 * | 12/2001 | Takahashi | H01R 13/41 439/733.1 |
| 7,083,478 | B1 * | 8/2006 | Kutsuna | H01R 13/41 439/733.1 |
| 2002/0142627 | A1 | 10/2002 | Kameyama | |
| 2005/0074999 | A1 | 4/2005 | Ohara | |
| 2010/0136852 | A1 | 6/2010 | Mito | |
| 2013/0267122 | A1 | 10/2013 | Hamada | |

FOREIGN PATENT DOCUMENTS

| | | | |
|---|---|---|---|
| JP | 2000-243495 | A | 9/2000 |
| JP | 2002-291135 | A | 10/2002 |
| JP | 2005-032512 | A | 2/2005 |
| JP | 2005-135794 | A | 5/2005 |
| JP | 2005-340068 | A | 12/2005 |
| JP | 2009-043676 | A | 2/2009 |
| JP | 2013-062142 | A | 4/2013 |
| JP | 2014-203627 | A | 10/2014 |

OTHER PUBLICATIONS

Communication dated Nov. 23, 2017 from the State Intellectual Property Office of the P.R.C. in counterpart Application No. 201580009356.4.

Communication dated Jan. 9, 2018 from the Japanese Patent Office in counterpart Application No. 2014-057295.

* cited by examiner

TERMINAL HOLDING STRUCTURE OF CONNECTOR

CROSS-REFERENCE TO RELATED APPLICATIONS

This application is a continuation of PCT International Application No. PCT/JP2015/056106 filed on Mar. 2, 2015 which claims the benefit of priority from Japanese Patent Application No. 2014-057295 filed on Mar. 19, 2014, the entire contents of which are incorporated herein by reference.

BACKGROUND OF THE INVENTION

1. Field of the Invention

The present invention relates to a terminal holding structure of a connector that holds a terminal by press fitting a straight portion of the terminal into a terminal holding hole formed on a housing.

2. Description of the Related Art

In a connector that is made of resin and is mounted on a circuit board (PCB), which is provided in a variety of electronic devices, for connecting a connector counterpart side such as a connector for connecting flexible integrated wiring, a straight portion of a terminal is press fitted into a terminal holding hole formed on a terminal holding wall of a housing, and the terminals are thereby being held. In this case, to enhance the holding power of the terminals and to keep a good electrical connection condition with the counterpart side terminals, a variety of conventional terminal holding structures have been developed.

For example, in Japanese Patent Application Laid-open No. 2013-062142 and Japanese Patent Application Laid-open No. 2009-043676, the structures of a terminal in which projecting portions that project in a direction orthogonal to the direction of press fitting into the terminal holding hole and are held in the terminal holding hole are formed in a region of a straight portion corresponding to the terminal holding hole have been disclosed. In this case, the with of the straight portion at the portion on which the projecting portions are formed (vicinity of projecting distal ends) has been made wider than that of the terminal holding hole. Thus, when the straight portion of the terminal is press fitted into the terminal holding hole, the projecting portions are in a state of biting into the inner walls of the terminal holding hole and the terminal is being held in the connector.

Consequently, the displacement of the terminals in the longitudinal direction (the press fitting direction and the opposite direction thereof) can be suppressed and, retreating of the terminals in the direction opposite to the press fitting direction can be prevented when fitting in the counterpart side connector and pushed by the counterpart side terminals. Furthermore, the swing of the terminals in the direction orthogonal to the longitudinal direction (for example, the up-down direction and left-right direction) is suppressed, and thus both ends of the terminals (end portions of the counterpart connector side and of the circuit board side) are prevented from being off from the location dimensions (alignment dimensions).

Meanwhile, for example, in the case of forming the projecting portions on a terminal of a flat-plate shape, when the projecting portions are formed by extrusion in a flat-plate shape by pressing corner portions of a prismatic terminal, the projecting portions become thin. When the straight portion of the terminal is press fitted into the terminal holding hole, the projecting portions cleave the inner walls of the terminal holding hole and cause the resin to plastically deform. Then, along the press-fitting path through which the projecting portions passed, grooves (scratches) are formed on the inner walls. Consequently, the terminal holding power in the direction opposite to the press-fitting direction is reduced, and the terminal may retreat along the grooves and slip out from the terminal holding hole. Furthermore, when the resin that has been spread out with the projecting portions is plastically deformed, the pressing force to the projecting portions is weakened and thus the terminal holding power is reduced.

SUMMARY OF THE INVENTION

It is an object of the present invention to provide a terminal holding structure of a connector that can enhance the holding power to the terminal press-fitted into the terminal holding hole, and enable the terminal to be held stably.

To achieve the above-described objective, a terminal holding structure of a connector according to one aspect of the present invention includes at least a pair of projecting portions, projecting to both sides in a direction orthogonal to a press-fitting direction, that is formed on an outer surface of a region of a straight portion of a terminal, the region corresponding to a terminal holding hole that is formed on a terminal holding wall of a housing made of resin and holds the terminal by press-fitting the straight portion of the terminal; and dents that are formed at distal end portions of the projecting portions projecting to both sides, a cross-section orthogonal to the straight portion being wedge-shaped, and a dimension between bottom portions thereof being made larger than a dimension of the terminal holding hole at a position into which the projecting portions projecting to both sides are press-fitted, wherein the projecting portion includes opposing surfaces that are formed in a smooth convex curve and face each other interposing the dent.

According to this, when the projecting portions are press-fitted into the terminal holding hole, because the resin of the terminal holding wall can be contained in the wedge-shaped dents of the projecting portions and can be elastically deformed avoiding escaping by being plastically deformed in the terminal holding hole, the wedges of the resin are driven into the dents, and thus the pressing force (restoring repulsive force by elastic deformation) exerted on the projecting portions from the terminal holding wall can be increased. The terminal holding hole that has been spread out with the projecting portions at the time of press fitting is returned to the original state (aperture width) by the restoring force of elastic deformation after the projecting portions pass, because the resin moves rearward, while being deformed elastically instead of plastically, along the press-fitting path of the projecting portions with the resin inside the aperture being contained in the dents. Consequently, it can be suppressed that grooves are formed on the inner walls of the terminal holding hole after having passed the projecting portions, and the terminal can be prevented from slipping out from the terminal holding hole.

According to another aspect of the present invention, in the terminal holding structure of a connector, it is preferable that a leading side of the projecting portion in the press-fitting direction is formed to taper toward the press-fitting direction. According to still another aspect of the present invention, in the terminal holding structure of a connector, it is preferable that a leading side of the projecting portion in the press-fitting direction is formed to separate upward and downward increasingly toward the press-fitting direction. Thus, when press-fitting the straight portion into the terminal holding hole, the projecting portions can be made to proceed toward the deep side of the terminal holding hole while gradually spreading out the terminal holding hole toward the rear from the front in the press-fitting direction with the tapered portions of the projecting portions. Consequently, because the resin that has been spread out with the projecting portions in the terminal holding hole can be smoothly moved toward the rear from the front in the press-fitting direction, the spread out resin can be made easier to deform elastically instead of plastically, and thus the forming of grooves on the inner walls of the terminal holding hole can be reliably suppressed.

According to still another aspect of the present invention, in the terminal holding structure of a connector, it is preferable that a leading side of the bottom portion of the dent of the projecting portion in the press-fitting direction is formed to taper toward the press-fitting direction. Thus, when press-fitting the straight portion into the terminal holding hole, the projecting portions can be made to proceed toward the deep side of the terminal holding hole while gradually spreading out the terminal holding hole toward the rear from the front in the press-fitting direction with the tapered portions of the bifurcating portions of the projecting portions in addition to the tapered portions of the projecting portions. Consequently, the resin that has been spread out with the projecting portions in the terminal holding hole can be moved further smoothly toward the rear from the front in the press-fitting direction, and thus the spread out resin can be made further easier to deform elastically, and the forming of grooves on the inner walls of the terminal holding hole can thereby be suppressed more reliably.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The following describes a terminal holding structure of a connector according to the present invention with reference to the accompanying drawings. As for the connector in the invention, a connector for a substrate which is mounted on a circuit board (PCB) and terminals thereof are made to electrically connect to the terminals (counterpart side terminal) of a counterpart side connector such as a connector for connecting flexible integrated wiring can be assumed as one example. However, the purpose of the invention is not limited to this.

Figure 1A:
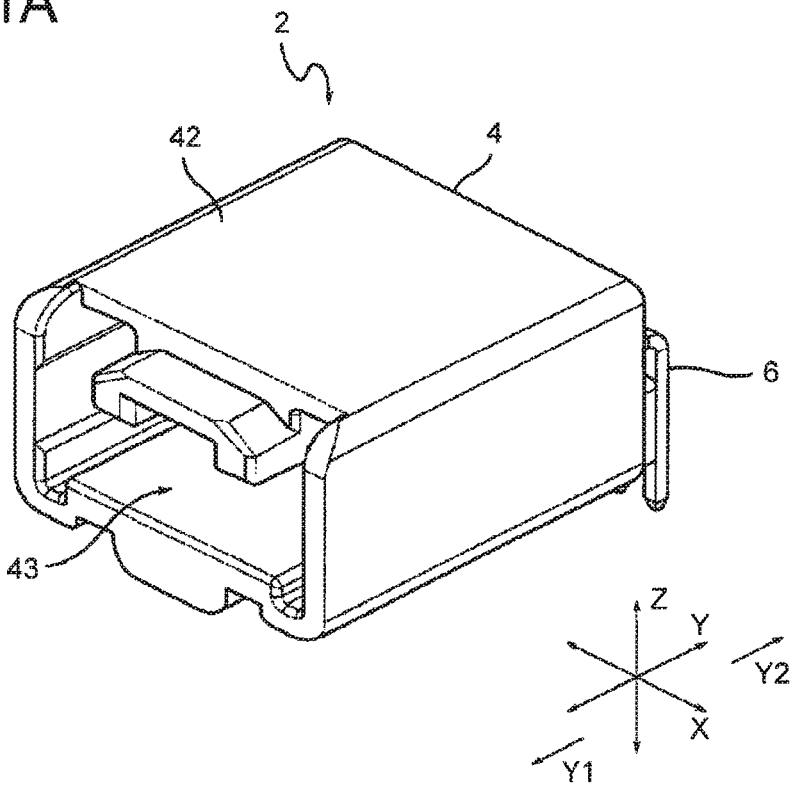
FIG. 1A is a diagram illustrating a configuration of a connector including a terminal holding structure according to a first embodiment of the present invention and is a perspective view illustrated from the front.
Figure 1B:
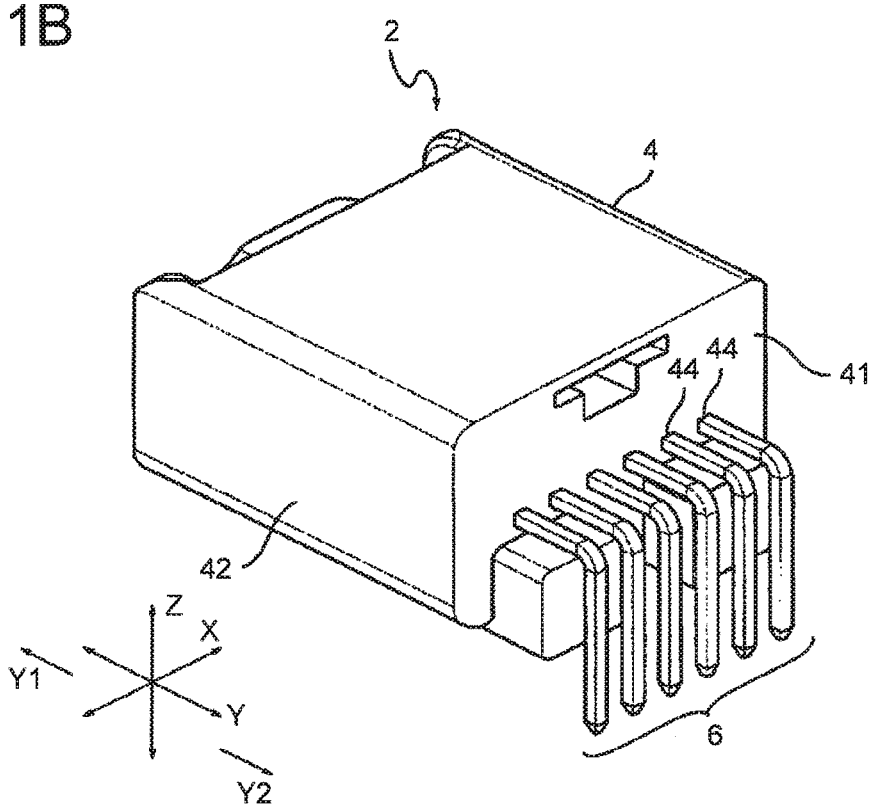
FIG. 1B is a diagram illustrating the configuration of the connector including the terminal holding structure in the first embodiment and is a perspective view illustrated from the rear.

In FIGS. 1A and 1B, the configuration of a connector 2 that includes a terminal holding structure according to a first embodiment of the invention is illustrated, and FIG. 1A is a perspective view illustrating the connector 2 from the front while FIG. 1B is a perspective view illustrating the connector 2 from the rear. In the description, the direction of arrows X that are indicated in FIGS. 1A and 1B is referred to as left-right direction (lateral direction), the direction of arrows Y is referred to as front-rear direction, and the direction of arrows Z is referred to as up-down direction. On the front-rear direction, the direction of an arrow Y1 is defined as the front (front side), and the direction of an arrow Y2 is defined as the rear (rear side).

As illustrated in FIGS. 1A and 1B, the connector 2 includes a housing 4 that a counterpart side connector (not depicted) is fitted in, and terminals 6 that are held by the housing 4 and are electrically connected to terminals (counterpart side terminals) of the counterpart side connector.

The housing 4 is formed of resin material of insulation and has a terminal holding wall 41 that stands in the up-and-down direction and holds the terminals 6, and a terminal accommodating portion 42 that is extending from the circumferential edges of the terminal holding wall 41 toward the front in a substantially angular cylindrical shape and surrounding the terminals 6. The counterpart side connector (not depicted) is inserted to the inner side of the terminal accommodating portion 42 from an opening 43 of the housing 4 and fitted in the terminal accommodating portion 42, and the counterpart side terminals are to be electrically connected to the terminals 6. In this case, the terminal accommodating portion 42 is formed in an angular cylindrical shape to be a size larger than a counterpart side connector so that the counterpart side connector can be inserted.

On the terminal holding wall 41, terminal holding holes 44 into which the terminals 6 are press fitted are formed passing through in the front-rear direction. In the first embodiment, because the terminal 6 is formed in a prismatic shape of which the cross-section in the front-rear direction is rectangular, the terminal holding hole 44 is formed to correspond to the cross-sectional shape of the terminal 6 and to be in a rectangular cross-section (similar shape) slightly larger than the terminal cross-sectional shape. The number of terminal holding holes 44 corresponds to the number of terminals 6 that the terminal holding wall 41 holds, and in the first embodiment, six identical terminal holding holes 44 are formed on the terminal holding wall 41 in juxtaposition at equal intervals in the left-right direction.

Figure 2A:
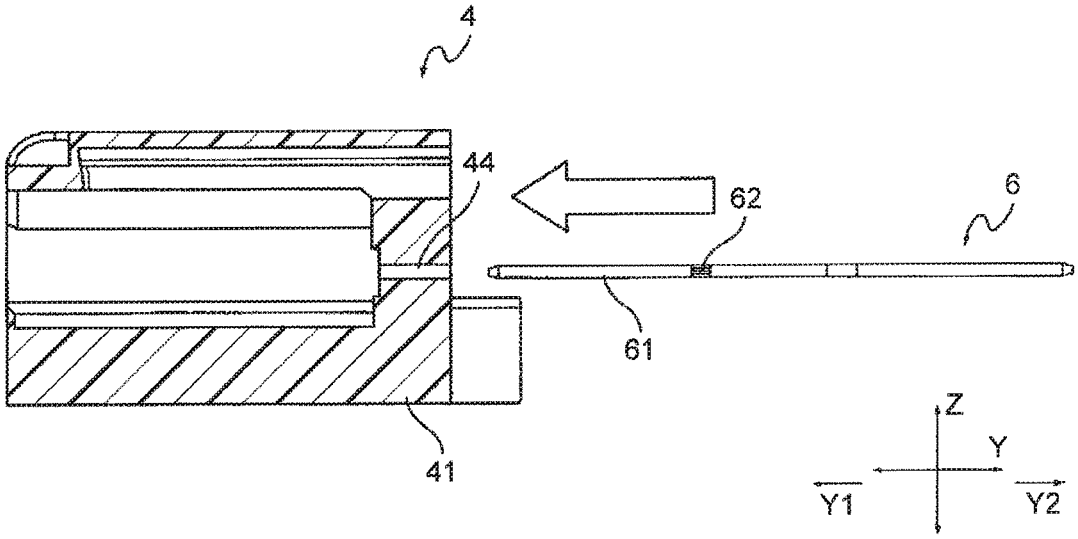
FIG. 2A is a cross-sectional view for explaining a state before a terminal is held in a terminal holding wall of the connector.

As illustrated in FIG. 2A, the terminal 6 is formed by extending conductive metal material in a certain direction for a certain length in a prismatic shape, and both ends thereof are made in a closed shape (tapered shape) by inclining four faces (upper and lower faces, and left and right lateral faces) toward the end portion (front end and rear end). The terminal 6 has a straight portion 61 extending in a straight line, and on the straight portion 61, projecting portions 62 that are to be held in the terminal holding hole 44 are formed.

Figure 2B:
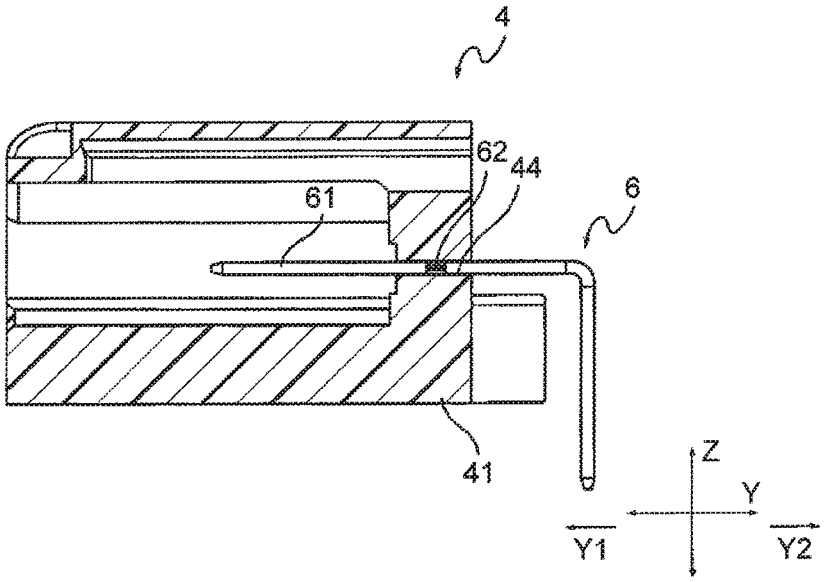
FIG. 2B is a cross-sectional view for explaining a state after the terminal is held in the terminal holding wall of the connector.

The terminal 6 is inserted into a rear opening of the terminal holding wall 41 from one end side (front side) of the straight portion 61 and is press fitted into the terminal holding wall 41 toward the front. The press-fitted terminal 6 is, in a state that the projecting portions 62 are held in the terminal holding hole 44 as illustrated in FIG. 2B, bent at substantially a right angle such that the other end of the straight portion 61 faces down. In the terminal 6 that has been bent, after one end side (lower end side) is inserted into a terminal hole of a circuit board (not depicted) and fixed by soldering and the like, the other end side (front end side) is to be connected to the counterpart side terminal (not depicted).

Figure 3A:
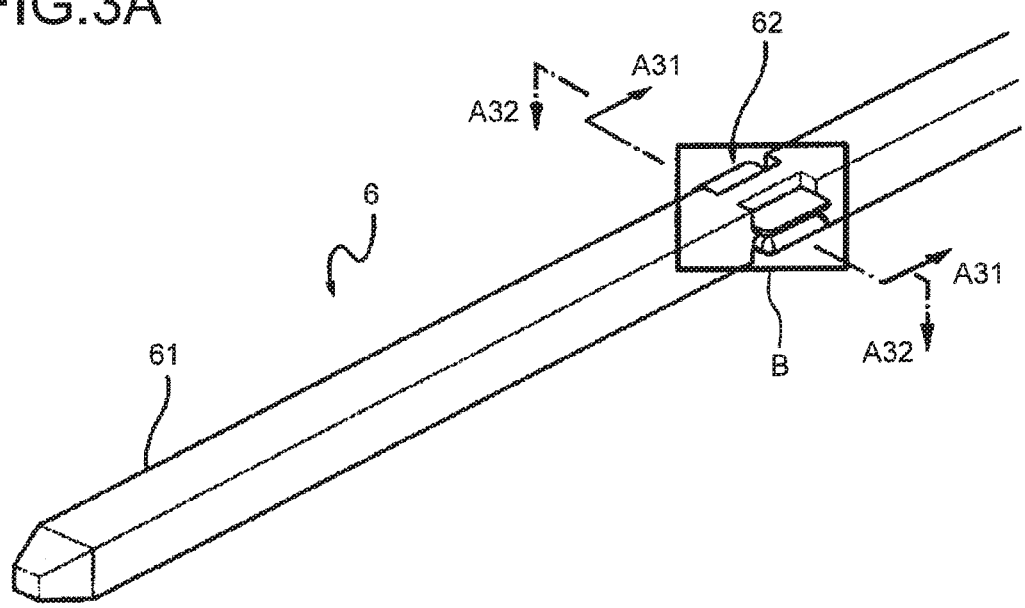
FIG. 3A is a perspective view illustrating projecting portions of the terminal in the first embodiment.
Figure 3B:
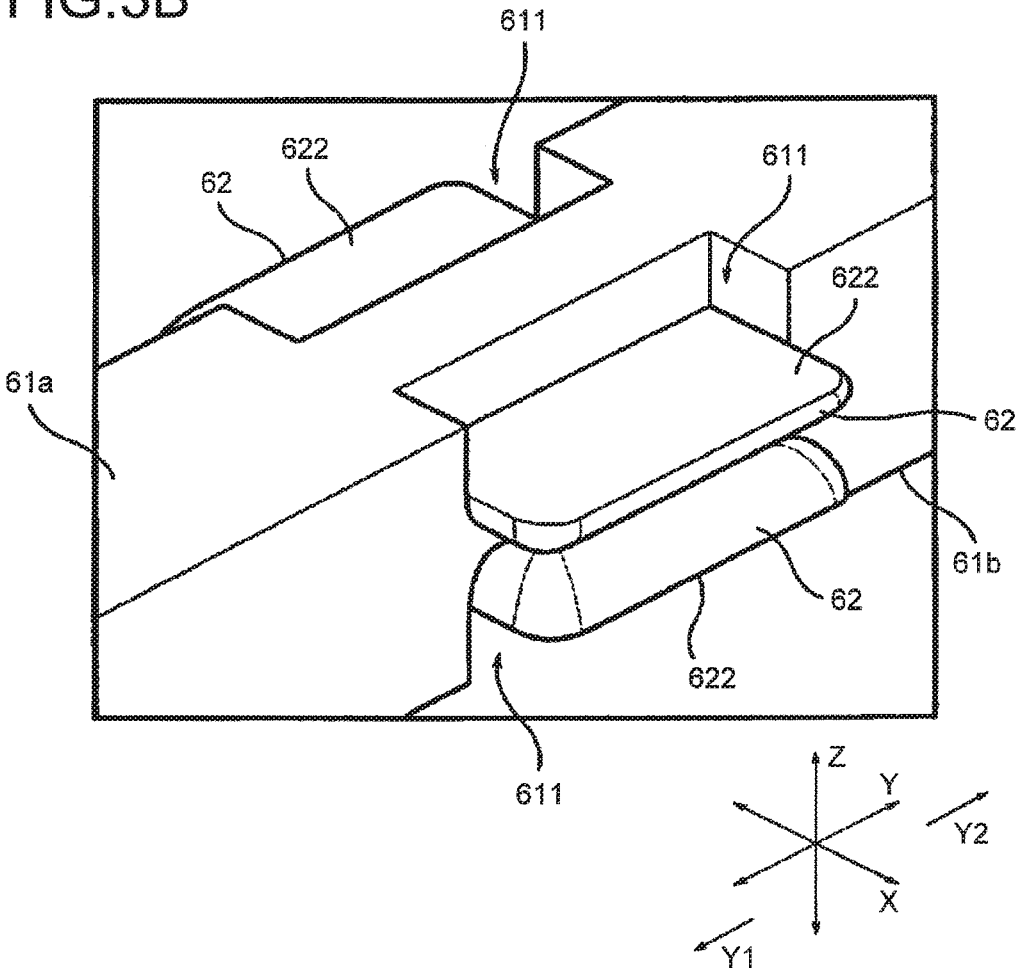
FIG. 3B is a detail view of the B portion in FIG. 3A.
Figure 4A:
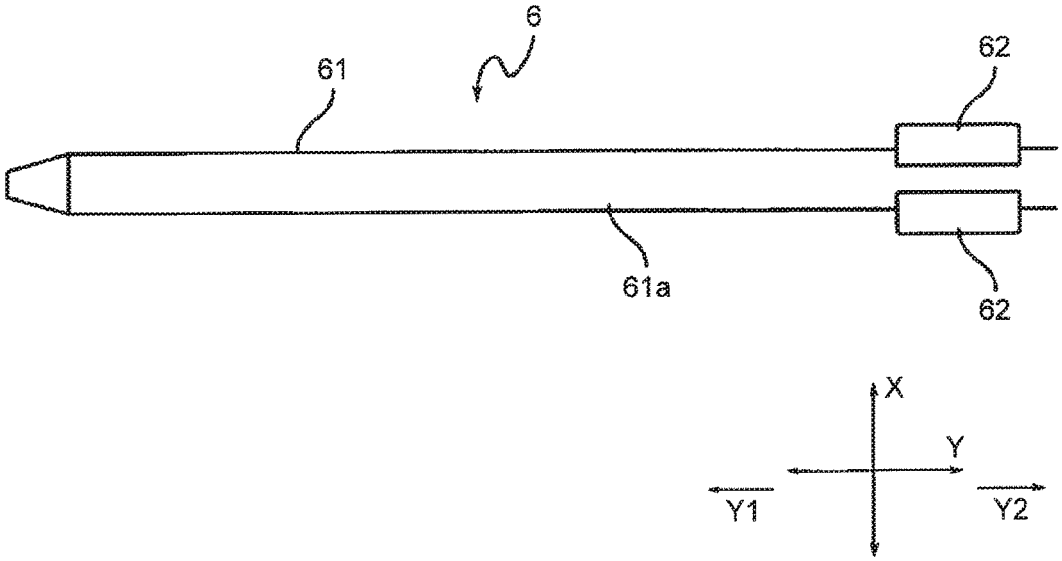
FIG. 4A is a diagram illustrating the projecting portions of the terminal in the first embodiment and is a diagram illustrated from above.
Figure 4B:
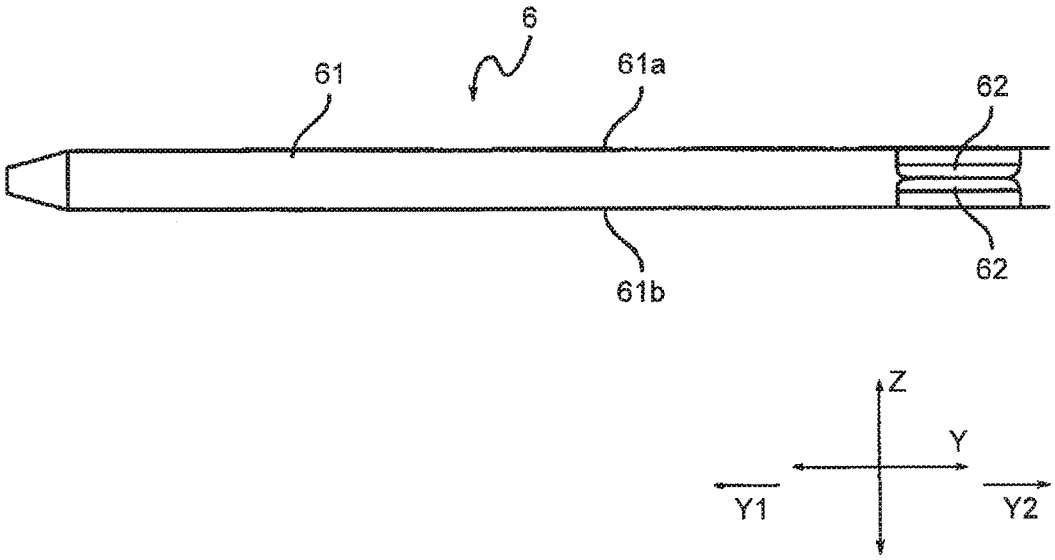
FIG. 4B is a diagram illustrating the projecting portions of the terminal in the first embodiment and is a diagram illustrated from the lateral side.

The present invention has features in the projecting portions 62 that are formed on the straight portion 61 of the terminal 6, and the following describes in detail the configuration of the projecting portions 62 in the first embodiment. FIGS. 3A to 4B illustrate the configuration of the projecting portions 62 in the first embodiment. FIG. 3A is a perspective view illustrating a portion of the projecting portions 62 of the terminal 6, FIG. 3B is a detail view of the B portion in FIG. 3A, FIG. 4A is a diagram illustrating the projecting portions 62 from above, and FIG. 4B is a diagram illustrating the projecting portions 62 from the lateral side.

As illustrated in FIGS. 3A to 4B, the projecting portions 62 are formed projecting in a direction orthogonal (left-right direction, in the first embodiment) to the press-fitting direction (direction of arrows in FIGS. 2A and 5B) that is the direction to press fit the terminal 6 into the terminal holding hole 44, at symmetrical positions of the region corresponding to the terminal holding hole 44 on the outer surface of the straight portion 61. In this case, the projecting portions 62 are formed by extrusion by press-processing the straight portion 61. Specifically, by pressing the corner portions of both sides in the left-right direction of an upper surface 61*a* and a lower surface 61*b* of the straight portion 61, a pair of projecting portions 62 extending along the front-rear direction is formed by extrusion on both sides in the left-right direction.

That is, on the straight portion 61, indentations 611 are formed at four locations on the top and bottom on both the right and left sides, and with the bottom of these indentations 611 as a press face 622, a first to a fourth projecting portions 62 are formed on the top and bottom on both the right and left sides. In the first embodiment, the indentations 611 are formed in a rectangular shape and the press faces 622 are formed in a flat shape parallel to the upper surface 61*a* and the lower surface 61*b*.

Figure 5A:
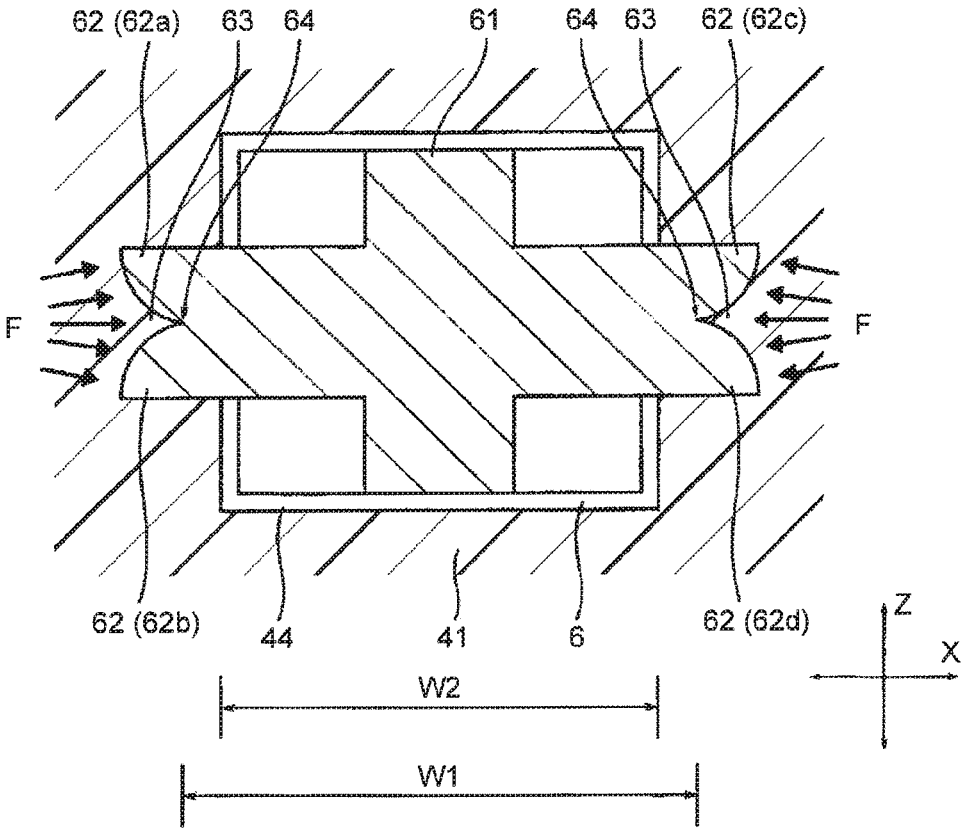
FIG. 5A is a cross-sectional view illustrating a state that the terminal is being held in the terminal holding wall of the connector and is a diagram illustrating a portion equivalent to the arrows A31 indicated in FIG. 3A viewed from the arrow direction.

In the first embodiment, when the press is performed on the straight portion 61, the hammering in the press from the top and bottom is made deeper than that is done conventionally. Consequently, as illustrated in FIG. 5A, on the straight portion 61, the projecting portions 62 are formed. The projecting portion 62 has a dent 63 on the distal end portion of which the width in the up-down direction of the cross-section orthogonal to the straight portion 61 (cross-section in the press-fitting direction of the terminal 6) narrows toward the center side from the outside in the left-right direction of the straight portion 61, what is called a wedge shape. In this case, the projecting portions 62 bifurcate upward and downward with the interposing wedge-shaped dent 63, and a first projecting portion 62*a* and a second projecting portion 62*b* are integrally formed interposing the dent 63 on one side in the left-right direction and a third projecting portion 62*c* and a fourth projecting portion 62*d* are integrally formed interposing the dent 63 on the other side. In the first projecting portion 62*a* and the second projecting portion 62*b*, and in the third projecting portion 62*c* and the fourth projecting portion 62*d*, opposing surfaces formed in a smooth convex curve are made to face each other interposing the dent 63 in the up-down direction. These opposing surfaces are brought into contact with each other at a bottom portion 64 of the dent 63, and the wedge-shaped dent 63 is thereby formed between the opposing surfaces.

As in the foregoing, by deepening the hammering in the press from the top and bottom performed on the straight portion 61, for the portion deepened by hammering, the walls (metal material) of the corner portions of the straight portion 61 are pushed out in addition on both sides in the left-right direction, and the wall thickness (dimension of up-down direction) and the projecting width (dimension of left-right direction) of the projecting portion 62 are increased. Thus, in the dents 63 of a pair of projecting portions 62 at a bilaterally symmetrical location, the width dimension between the bottom portions 64 (dimension W1 indicated in FIG. 5A) is formed wider than the width dimension of the terminal holding hole 44 (dimension W2 indicated in FIG. 5A) at the position that the pair of projecting portions 62 is press fitted. FIG. 5A is a diagram illustrating a state that the terminal 6 is being held in the terminal holding wall 41, by a cross-section of a portion equivalent to the arrows A31 indicated in FIG. 3A viewed from the arrow direction.

By making the projecting portions 62 in such a form, when the straight portion 61 is press fitted into the terminal holding hole 44, as illustrated in FIG. 5A, the resin of the terminal holding wall 41 can be contained in the wedge shaped dents 63 of the projecting portions 62, and thus in the dents 63 of the projecting portions 62, the resin can be prevented from plastically deforming and escaping. That is, the resin can be made to deform elastically instead of plastically inside the terminal holding hole 44 and the wedges of the resin can be driven into the dents 63, and thus the pressing force (restoring repulsive force by elastic deformation) exerted on the projecting portions 62 from the terminal holding wall 41 can be increased.

Figure 5B:
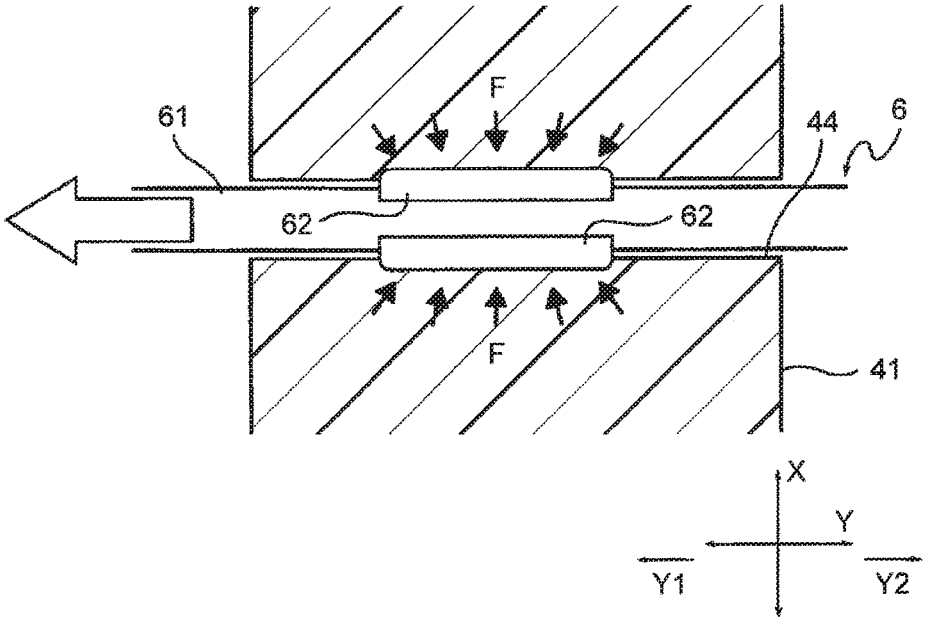
FIG. 5B is a cross-sectional view illustrating a state that the terminal is being held in the terminal holding wall of the connector and is a diagram illustrating a portion equivalent to the arrows A32 indicated in FIG. 3A viewed from the arrow direction.

The terminal holding hole 44 that has been spread out by the projecting portions 62 at the time of press fitting is, as illustrated in FIG. 5B, returned to the original state (aperture width) by the restoring force of elastic deformation after the projecting portions 62 pass, because the resin moves rearward, while being deformed elastically instead of plastically, along the press-fitting path of the projecting portions 62 with the resin inside the aperture being contained in the dents 63. Thus, it can be suppressed that grooves are formed along the press-fitting path of the projecting portions 62 on the inner walls of the terminal holding hole 44 after the projecting portions 62 passed. Consequently, the rear ends of the projecting portions 62 interfere with the inner walls of the terminal holding hole 44 that have been returned to the original state (aperture width), and thus the terminal 6 can be prevented from slipping out from the terminal holding hole 44. FIG. 5B is a diagram illustrating a state that the terminal 6 is being held in the terminal holding wall 41, by a cross-section of a portion equivalent to the arrows A32 indicated in FIG. 3A viewed from the arrow direction.

According to the first embodiment as in the foregoing, because the friction force between the terminal holding hole 44 and the projecting portions 62 can be increased and the terminal holding power of the terminal holding hole 44 (the force exerted on the projecting portions 62 indicated by arrows F in FIGS. 5A and 5B) can be enhanced, the terminal 6 can be stably held by the terminal holding wall 41. The length of the projecting portions 62 (dimension of front-rear direction) can be extended up to the length of the terminal holding hole 44. For example, when the lengths of the projecting portions 62 and the terminal holding hole 44 are made to match, the active region of the terminal holding power to the projecting portions 62 can be expanded up to the maximum, and thus the terminal 6 can be held more stably.

As in the foregoing, the present invention has been described based on the first embodiment as illustrated in FIGS. 1A to 5B. However, the above-described embodiment is merely one example of the invention, and the invention is not limited to this.

Even when the configuration of the projecting portions is altered as in a second embodiment illustrated in FIGS. 6A to 8 and in a third embodiment illustrated in FIGS. 9A to 11, they can have the operation and effect the same as those of the first embodiment, and further have the operation and effect that are unique to those embodiments. The following describes the second embodiment and the third embodiment. In these embodiments, the basic configuration of the connector (housing and terminals) is assumed to be the same as that of the first embodiment (FIGS. 1A to 5B), and the following describes the feature points (configuration of the projecting portions) of the respective embodiments that are different from the first embodiment.

Figure 6A:
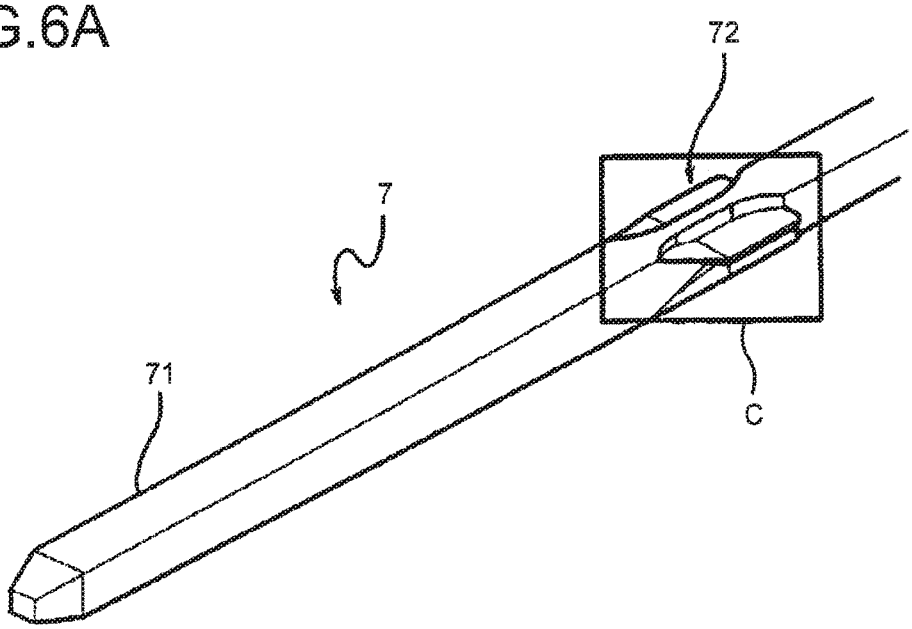
FIG. 6A is a perspective view illustrating projecting portions of a terminal according to a second embodiment of the invention.
Figure 6B:
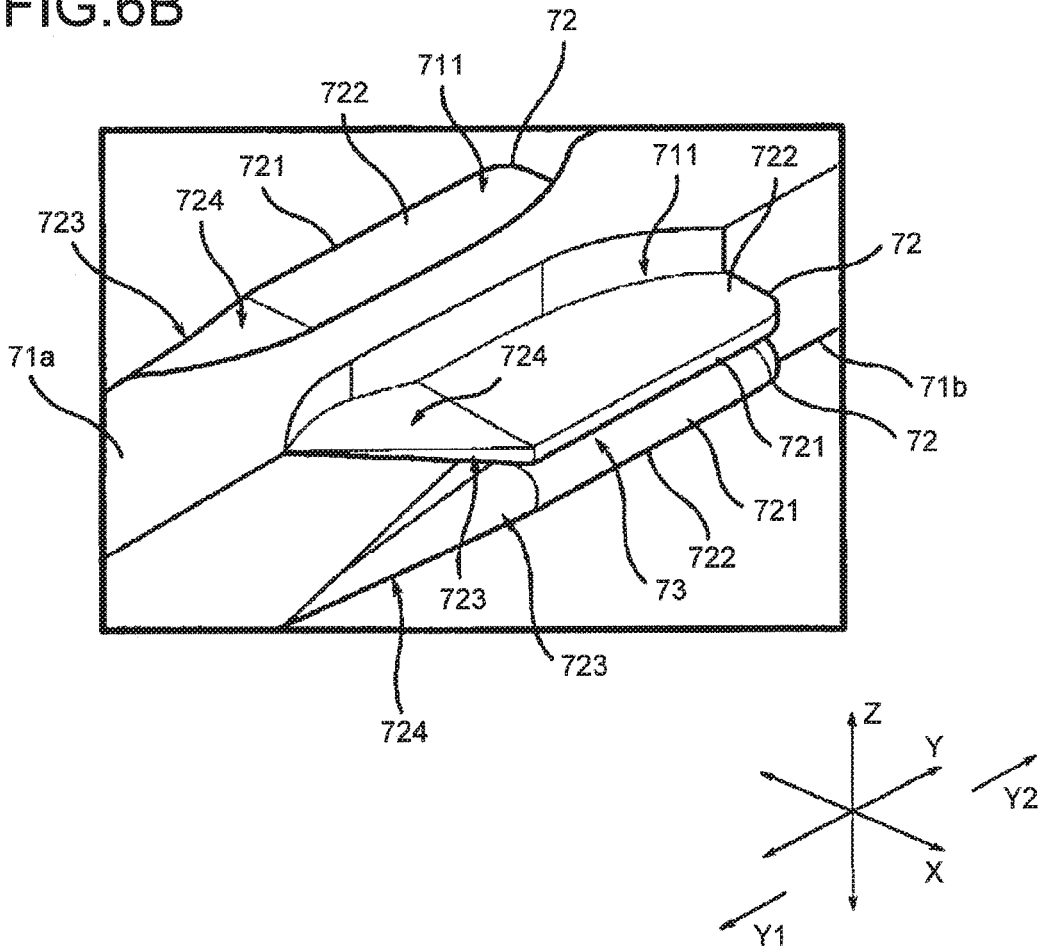
FIG. 6B is a detail view of the C portion in FIG. 6A.
Figure 7A:
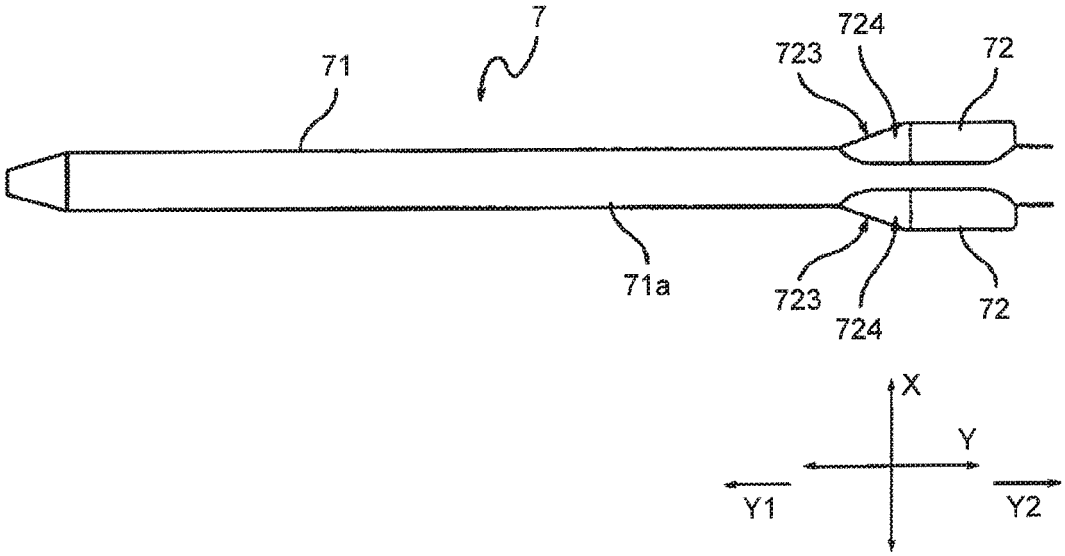
FIG. 7A is a diagram illustrating the projecting portions of the terminal in the second embodiment and is a diagram illustrated from above.
Figure 7B:
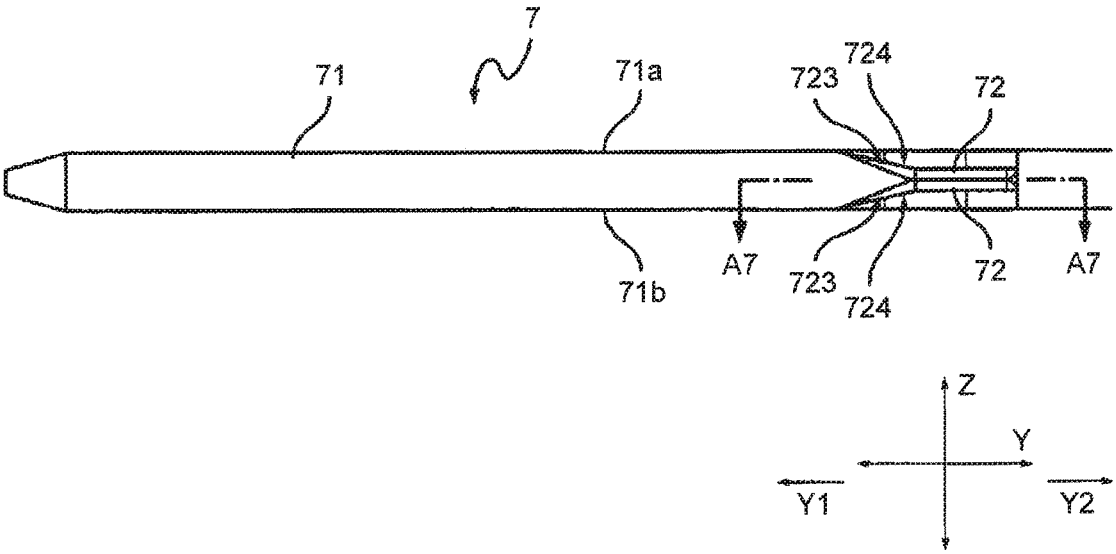
FIG. 7B is a diagram illustrating the projecting portions of the terminal in the second embodiment and is a diagram illustrated from the lateral side.
Figure 8:
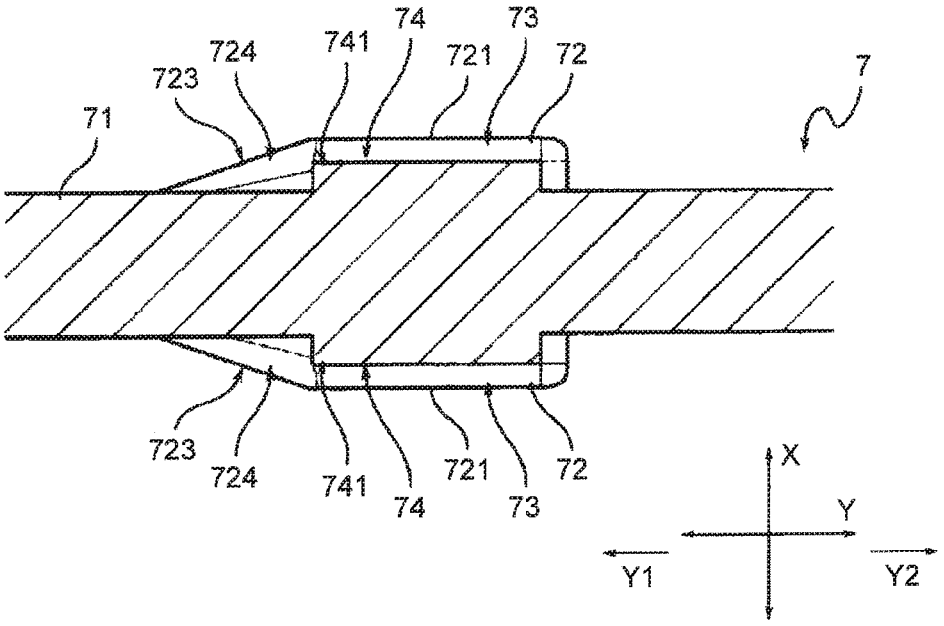
FIG. 8 is a cross-sectional view illustrating a cross-section of the projecting portions at the arrows A7 portion indicated in FIG. 7B, being viewed from the arrow direction.

In FIGS. 6A to 8, the configuration of projecting portions 72 according to the second embodiment is illustrated. FIG. 6A is a perspective view illustrating a portion of the projecting portions 72 of a terminal 7, FIG. 6B is a detail view of the C portion in FIG. 6A, FIG. 7A is a diagram illustrating the projecting portions 72 from above, FIG. 7B is a diagram illustrating the projecting portions 72 from the lateral side, and FIG. 8 is a cross-sectional view illustrating the cross-section of the projecting portions 72 at the arrows A7 portion indicated in FIG. 7B, being viewed from the arrow direction.

As illustrated in FIGS. 6A to 8, on a straight portion 71 of the terminal 7 in the second embodiment, by pressing the corner portions of both sides in the left-right direction of an upper surface 71*a* and a lower surface 71*b*, the projecting portions 72 that bifurcate upward and downward with an interposing wedge-shaped dent 73 are formed by extrusion so as to extend along the front-rear direction on both sides of the left-right direction.

In this case, the projecting portions 72 on the leading side in the press-fitting direction (front side) of the terminal 7, that is, on the moving direction side in moving the terminal 7 to the terminal holding hole 44 at the time of press fitting the terminal 7, are made to taper off toward the press-fitting direction. That is, in the projecting portions 72, the front side of a lateral portion 721 is formed in a tapered shape such that the projecting width (dimension of left-right direction) on the front side gradually narrows toward the front and matches the width of the straight portion 71 at the front end. Furthermore, the projecting portions 72 on the leading side in the press-fitting direction (front side) are formed being separated upward and downward toward the press-fitting direction. That is, in the projecting portions 72, the front side of a press face 722 is formed in a tapered shape such that the wall thickness (dimension of up-down direction) on the front side is made gradually thinner toward the front and is substantially gone at the front end.

By making the projecting portions 72 in such a form, when press-fitting the straight portion 71 into the terminal holding hole 44, because the projecting portions 72 proceed to the deep side of the terminal holding hole 44 while gradually spreading out the terminal holding hole 44 toward the rear from the front in the press-fitting direction with tapered portions 723 and 724 of the lateral portions 721 and the press faces 722, the resin inside the terminal holding hole 44 that has been spread out with the projecting portions 72 can be smoothly moved toward the rear from the front in the press-fitting direction. Consequently, the resin that has been spread out with the projecting portions 72 can be made easier to deform elastically instead of plastically, and thus the forming of grooves on the inner walls of the terminal holding hole 44 along the press-fitting path of the projecting portions 72 can be reliably suppressed.

The projecting portions 72 does not need to be formed in a tapered shape. For example, the projecting portions 72 can be formed in a curved shape (in a convex curve) in which the projecting width of the front side narrows in a curved manner toward the front and matches the width of the straight portion 71 at the front end, and can also be formed in a curved shape (in a concave curve) in which the wall thickness of the front side is made thinner in a curved manner toward the front and is substantially gone at the front end. Even when the projecting portions 72 are formed in such a curved shape, the resin in the terminal holding hole 44 can be smoothly moved toward the rear from the front in the press-fitting direction. Furthermore, in the first embodiment, by making dents in a rectangular shape at four locations of the top and bottom on both the right and left sides of the straight portion 61, the first to the fourth projecting portions 62 (the indentations 611, in a different perception) are formed on the top and bottom on both the right and left sides. In the second embodiment, by making dents at four locations of the top and bottom in the left-right direction of the straight portion 71 such that the front side and the rear side of the press face 722 curve convexly, the first to the fourth projecting portions 72 (indentations 711) are formed on the top and bottom on both the right and left sides.

Figure 9A:
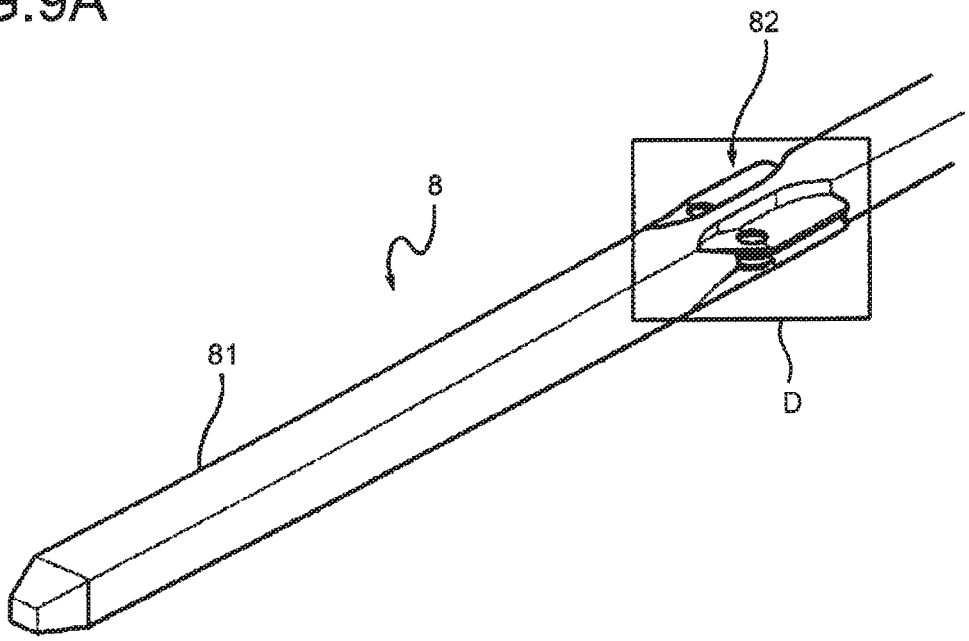
FIG. 9A is a perspective view illustrating projecting portions of a terminal according to a third embodiment of the invention.
Figure 9B:
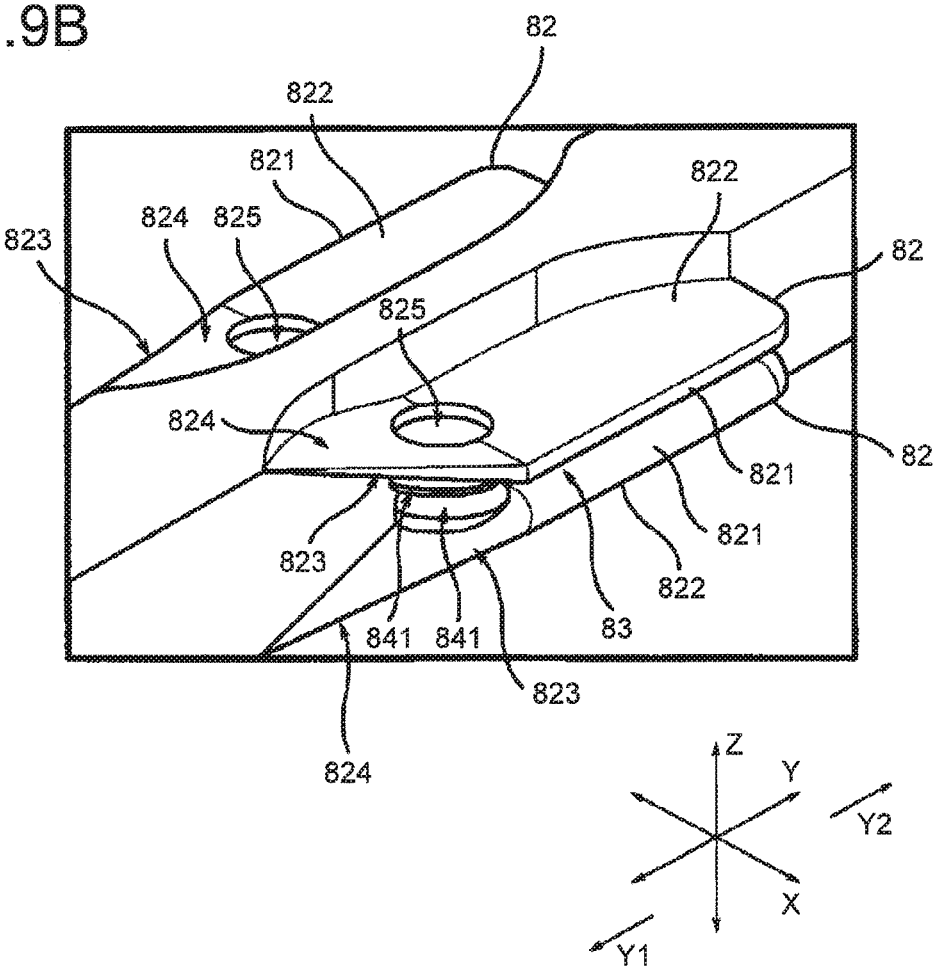
FIG. 9B is a detail view of the D portion in FIG. 9A.
Figure 10A:
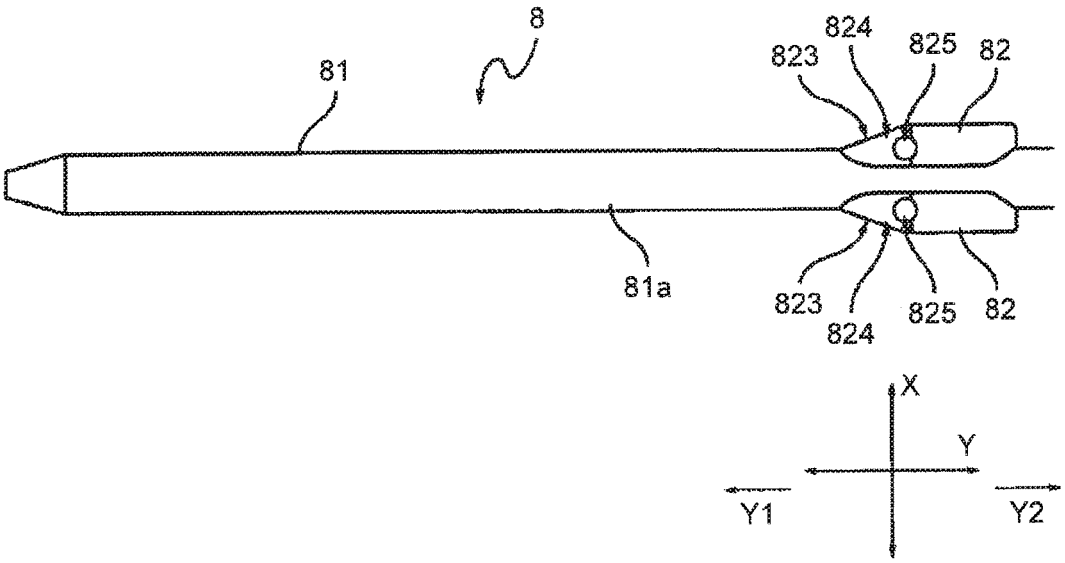
FIG. 10A is a diagram illustrating the projecting portions of the terminal in the third embodiment and is diagram illustrated from above.
Figure 10B:
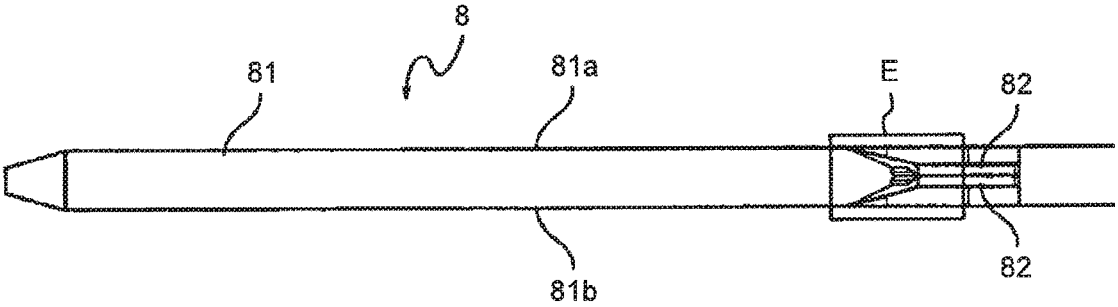
FIG. 10B is a diagram illustrating the projecting portions of the terminal in the third embodiment and is a diagram illustrated from the lateral side.
Figure 10C:
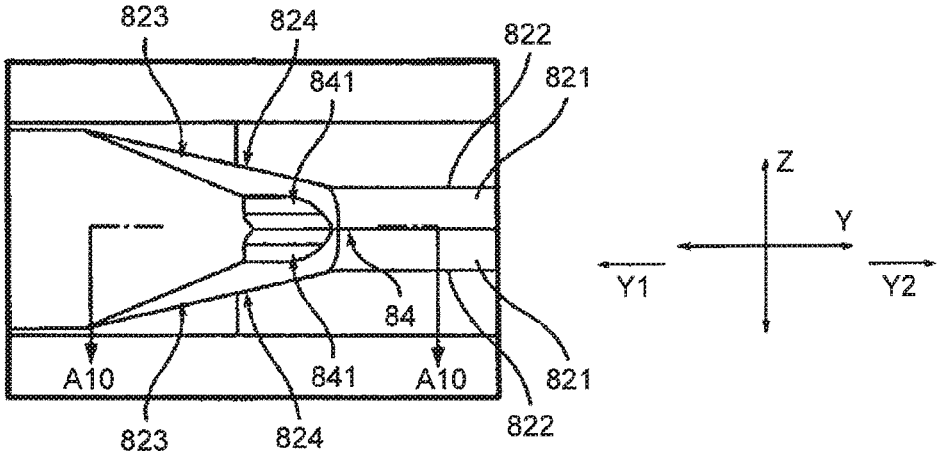
FIG. 10C is a detail view of the E portion in FIG. 10B.
Figure 11:
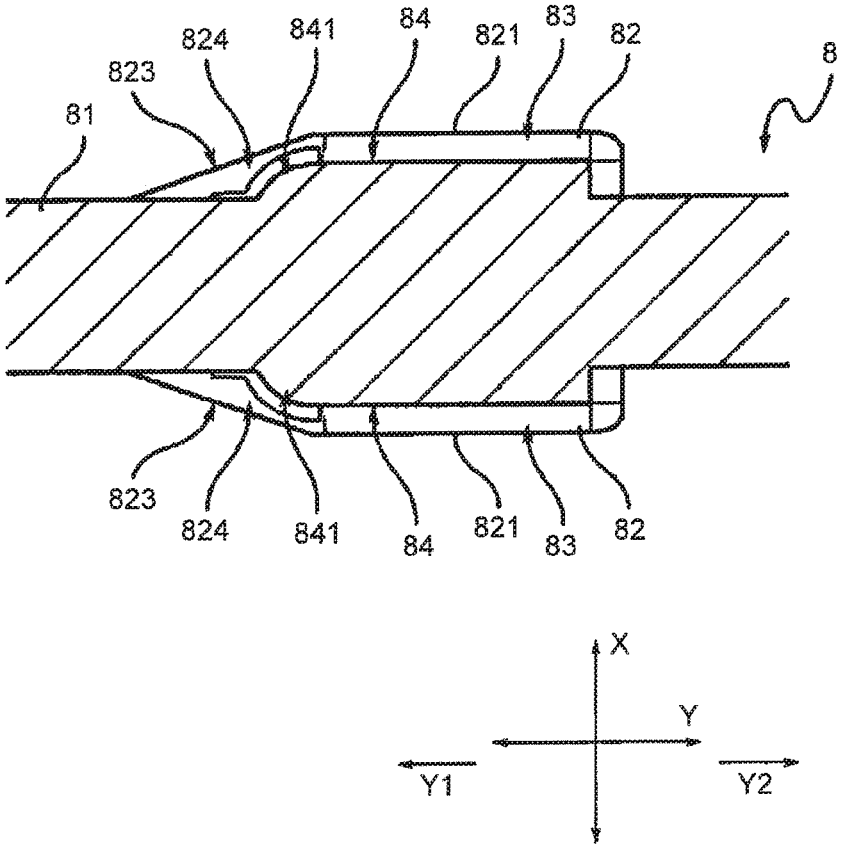
FIG. 11 is a cross-sectional view illustrating a cross-section of the projecting portions at the arrows A10 portion indicated in FIG. 10C, being viewed from the arrow direction.

In FIGS. 9A to 11, the configuration of projecting portions 82 according to the third embodiment is illustrated. FIG. 9A is a perspective view illustrating a portion of the projecting portions 82 of a terminal 8, FIG. 9B is a detail view of the D portion in FIG. 9A, FIG. 10A is a diagram illustrating the projecting portions 82 from above, FIG. 10B is a diagram illustrating the projecting portions 82 from the lateral side, FIG. 10C is a detail view of the E portion in FIG. 10B, and FIG. 11 is a cross-sectional view illustrating the cross-section of the projecting portions 82 at the arrows A10 portion indicated in FIG. 10C, being viewed from the arrow direction.

As illustrated in FIGS. 9A to 11, in the projecting portions 82 in the third embodiment, as the same as those of the projecting portions 72 of the second embodiment, the projecting portions 82 interposing a wedge-shaped dent 83 are formed on the top and bottom on both the right and left sides, and on the front side of lateral portions 821 and press faces 822 of the projecting portions 82, tapered portions 823 and 824 are included. In addition, in a bottom portion 84 of the dent 83 of the projecting portions 82 extending in the front-rear direction, in other words, in the portion that bifurcates upward and downward on both the right and left sides of the projecting portions 82, the leading side in the press-fitting direction of the terminal 8 (front side) is formed to taper off toward the press-fitting direction.

In the third embodiment, by pressing the press faces 822 from the top and bottom in a columnar shape near the region at which a flat-shaped portion changes to a tapered portion, curved portions 841 are formed by extrusion on the bottom portion 84 such that the front side is in a curved shape. That is, by pressing the appropriate regions of the press faces 822, columnar indentations 825 are formed and the wall (metal material) of the front side portion of the bottom portion 84 (the portion equivalent to a front side portion 741 of a bottom portion 74 of the dent 73 in the projecting portions 72 illustrated in FIG. 8) curves and is pushed out for the portion of the indentations 825. Consequently, as illustrated in FIG. 11, in the bottom portion 84, the curved portion 841 in a convex curve is formed on the front side such that the projecting width (dimension of left-right direction) on the front side gradually narrows in a curved manner toward the front and matches the width of the straight portion 81 at the front end. It is also possible to form them in a tapered shape, instead of in such a curved shape, such that the projecting with (dimension of left-right direction) on the front side gradually narrows toward the front and matches the width of the straight portion 81 at the front end.

The projecting portions 72 in the second embodiment, as illustrated in FIG. 8, are in a state in which the front side portions 741 of the bottom portions 74 are projecting in the left-right direction from the lateral surfaces of the straight portion 71 (in a state of overhanging vertically with respect to the press-fitting direction), and thus, when press-fitting the straight portion 71 into the terminal holding hole 44, the resin that moves in the terminal holding hole 44 toward the rear from the front in the press-fitting direction interferes with the front side portion 741 of the bottom portion 74 and is pushed hack toward the front easily.

In contrast, in the third embodiment, when press-fitting the straight portion 81 into the terminal holding hole 44, the straight portion 81 can be made to proceed toward the deep side of the terminal holding hole 44 while gradually spreading out the terminal holding hole 44 toward the rear from the front in the press-fitting direction further with the curved portions 841 of the bottom portions 84 in addition to the tapered portions 823 and 824 of the lateral portions 821 and the press faces 822. Consequently, as compared with the second embodiment, the resin in the terminal holding hole 44 that has been spread out with the projecting portions 82 can be moved further smoothly toward the rear from the front in the press-fitting direction. Thus, the resin that has been spread out with the projecting portions 82 can be made further easier to deform elastically instead of plastically, and thus the forming of grooves on the inner walls of the terminal holding hole 44 along the press-fitting path of the projecting portions 82 can be suppressed more reliably.

It is obvious for those skilled in the art that the present invention can be implemented in a modified or altered form within a scope of the gist of the invention, and such modifications and alterations naturally fall within the scope of the claims of the invention. For example, in the respective embodiments in the foregoing, the terminals are formed in a prismatic shape for which the cross-section in the front-rear direction is rectangular. However, the terminals may be formed in a rod-like shape for which the cross-section is a circle, ellipse, and others. On the straight portion, a plurality of pairs of projecting portions, instead of a pair of projecting portions, may be formed in juxtaposition at certain intervals in the front-rear direction. In either of a pair or a plurality of pairs, the symmetrical position of the projecting portions that constitute a pair may be in the left-right direction or the up-down direction. Furthermore, the projecting portions that constitute a pair may be formed at positions displaced in the front-rear direction on both the right and left sides or on both the top and bottom sides, instead of at the symmetrical positions in the left-right direction or up-down direction. As for the dimension between the bottom portions of the dents of the projecting portions that constitute a pair displaced in the front-rear direction and the dimension of the terminal holding hole into which the projecting portions that constitute the pair are press fitted, the dimension at the time of having displaced virtually any one of the projecting portions in the front-rear direction up to the symmetrical position of the other of the projecting portions is applied with necessary modification.

According to the present invention, implemented can be the terminal holding structure of a connector that is capable of enhancing the holding power of the terminal press fitted into the terminal holding hole and stably holding the terminal.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A terminal holding structure of a connector comprising:

at least a pair of projecting portions, projecting to both sides in a direction orthogonal to a press-fitting direction, that is formed on an outer surface of a region of a straight portion of a terminal, the region corresponding to a terminal holding hole that is formed on a terminal holding wall of a housing made of resin and holds the terminal by press-fitting the straight portion of the terminal; and dents that are formed at distal end portions of the projecting portions projecting to both sides, a cross-section orthogonal to the straight portion being wedge-shaped, and a dimension between bottom portions thereof being made larger than a dimension of the terminal holding hole at a position into which the projecting portions projecting to both sides are press-fitted, wherein the projecting portion includes opposing surfaces that are formed in a smooth convex curve and face each other interposing the dent, and the press-fitting direction is a direction in which the straight portion of the terminal is press fit into the terminal holding hole.

2. The terminal holding structure of a connector according to claim 1, wherein a leading side of the projecting portion in the press-fitting direction is formed to taper toward the press-fitting direction.

3. The terminal holding structure of a connector according to claim 1, wherein a leading side of the projecting portion in the press-fitting direction is formed to separate upward and downward increasingly toward the press-fitting direction.

4. The terminal holding structure of a connector according to claim 1, wherein a leading side of the bottom portion of the dent of the projecting portion in the press-fitting direction is formed to taper toward the press-fitting direction.

5. The terminal holding structure of a connector according to claim 2, wherein a leading side of the bottom portion of the dent of the projecting portion in the press-fitting direction is formed to taper toward the press-fitting direction.

6. The terminal holding structure of a connector according to claim 3, wherein a leading side of the bottom portion of the dent of the projecting portion in the press-fitting direction is formed to taper toward the press-fitting direction.

* * * * *